US011297884B2

(12) United States Patent
Harris

(10) Patent No.: US 11,297,884 B2
(45) Date of Patent: Apr. 12, 2022

(54) TRIM PIECE FOR AN APPAREL ITEM

(71) Applicant: NIKE, Inc., Beaverton, OR (US)

(72) Inventor: Donavan Harris, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 222 days.

(21) Appl. No.: 16/735,855

(22) Filed: Jan. 7, 2020

(65) Prior Publication Data

US 2020/0138136 A1 May 7, 2020

Related U.S. Application Data

(62) Division of application No. 15/486,800, filed on Apr. 13, 2017, now Pat. No. 10,709,187.

(60) Provisional application No. 62/323,855, filed on Apr. 18, 2016.

(51) Int. Cl.

| | |
|---|---|
| ***A41D 1/089*** | (2018.01) |
| ***A41C 3/12*** | (2006.01) |
| ***A41D 13/00*** | (2006.01) |
| ***A41D 31/102*** | (2019.01) |
| ***A41C 3/00*** | (2006.01) |
| *A41F 9/00* | (2006.01) |
| *A41F 9/02* | (2006.01) |

(52) U.S. Cl.

CPC ..... *A41D 1/089* (2018.01); *A41C 3/0057* (2013.01); *A41C 3/12* (2013.01); *A41D 31/102* (2019.02); *A41D 13/0015* (2013.01); *A41D 2300/332* (2013.01); *A41F 9/00* (2013.01); *A41F 9/025* (2013.01)

(58) Field of Classification Search

CPC . A41D 1/06; A41D 1/08; A41D 27/00; A41D 27/27; A41D 13/0015; A41D 2300/33; A41D 2300/332; A41D 1/089; A41C 3/0057; A41C 3/12; A41F 9/00; A41F 9/025; A41F 9/04; A41B 9/14; A41B 2300/332; A41B 2300/33

USPC ..... 2/236, 237

See application file for complete search history.

(56) References Cited

U.S. PATENT DOCUMENTS

| | | | | |
|---|---|---|---|---|
| 1,429,800 A | | 9/1922 | Thero | |
| 1,697,630 A | | 1/1929 | Bricker | |
| 1,789,823 A | * | 1/1931 | Lehman | A41F 9/02 2/237 |

(Continued)

FOREIGN PATENT DOCUMENTS

| | | |
|---|---|---|
| DE | 1460012 A1 | 2/1969 |
| EP | 1936546 A1 | 6/2008 |

(Continued)

OTHER PUBLICATIONS

Extended European Search Report received for European Patent Application No. 20172831.8, dated Oct. 28, 2020, 8 pages.

(Continued)

*Primary Examiner* — Heather Mangine

(74) *Attorney, Agent, or Firm* — Shook, Hardy & Bacon LLP

(57) ABSTRACT

A trim piece is provided herein comprising a first zone adapted to be folded over an edge of an apparel item, a second zone, and a third zone interposed between the first and second zones. The trim piece is positioned on the apparel item such that a majority of the trim piece is positioned on an outer-facing surface of the apparel item.

20 Claims, 6 Drawing Sheets

(56) References Cited

U.S. PATENT DOCUMENTS 1,825,271 A * 9/1931 Karberg ..... A41F 9/025 2/237
2,060,467 A * 11/1936 Krein ..... A41F 9/02 2/237
2,128,876 A * 8/1938 Boysen ..... A41F 9/02 2/237
2,130,552 A 9/1938 Kuhn
2,438,804 A 3/1948 Hardie
2,619,647 A * 12/1952 Giletti ..... A41D 1/06 2/236
2,708,274 A 5/1955 Vander
2,751,599 A 6/1956 Peterson
3,064,269 A * 11/1962 Scheitlin ..... A41F 9/02 2/221
3,069,691 A 12/1962 Svojse
3,078,469 A * 2/1963 Lynam ..... A41F 9/02 2/338
3,155,986 A 11/1964 Miller
3,384,905 A 5/1968 Brinovec
3,559,213 A 2/1971 Goodman
3,678,514 A * 7/1972 Safrit ..... A41D 1/06 2/212
3,711,868 A 1/1973 Kristof
3,735,424 A 5/1973 Maggio et al.
3,761,962 A * 10/1973 Myers ..... A41D 27/28 2/79
3,788,366 A * 1/1974 Campbell, Sr. ..... D03D 15/56 139/421
3,805,299 A 4/1974 Saad-Chujfi
3,813,698 A * 6/1974 Campbell, Sr. ..... D03D 15/56 2/237
3,854,978 A * 12/1974 Campbell, Sr. ..... D06N 7/0092 427/375
3,945,051 A * 3/1976 Burkard ..... A41D 1/089 2/400
4,146,934 A 4/1979 Cohen
4,168,197 A * 9/1979 Michimae ..... A41F 9/00 156/182
4,168,546 A 9/1979 O'Connor
4,480,339 A * 11/1984 Hubbard, Sr. ..... A41F 9/02 2/237
4,551,994 A * 11/1985 Vailati ..... A41F 9/02 66/190
4,583,478 A 4/1986 Bassetti
4,970,728 A * 11/1990 D'Ambrosio ..... A41F 9/02 2/220
RE33,586 E * 5/1991 Graff ..... D03D 15/56 2/221
5,040,244 A * 8/1991 Tubbs ..... A41F 9/025 2/237
5,052,058 A * 10/1991 Mueller ..... D04B 21/20 2/228
5,070,542 A 12/1991 LaVelle et al.
5,168,581 A 12/1992 Garcia et al.
5,182,815 A 2/1993 Young
5,375,266 A * 12/1994 Crisco ..... A41F 9/025 2/221
5,452,591 A * 9/1995 King ..... D04B 25/14 66/83
5,483,702 A 1/1996 D'Ambrosio
5,675,842 A 10/1997 Schaefer
5,963,988 A * 10/1999 Jackson, Jr. ..... A41F 9/025 139/422
6,041,441 A * 3/2000 Counts ..... A41D 1/08 2/227
6,138,282 A 10/2000 Follese
6,264,530 B1 7/2001 Cosentino
6,286,341 B2 * 9/2001 Jackson, Jr ..... D04B 21/18 2/221
7,278,173 B2 10/2007 Turner
7,834,236 B2 11/2010 Middlesworth et al.
2004/0040070 A1 3/2004 Wong
2005/0081275 A1 * 4/2005 Galvao ..... A41D 7/005 2/67
2008/0078012 A1 4/2008 Mario
2009/0038046 A1 2/2009 Moore et al.
2009/0055998 A1 * 3/2009 Blumenfeld ..... A41B 9/14 2/403
2010/0132093 A1 * 6/2010 Ogawa ..... B32B 27/12 2/272
2010/0205713 A1 8/2010 Takamoto et al.
2010/0275344 A1 * 11/2010 Demarest ..... D05B 27/00 2/237
2012/0011638 A1 * 1/2012 Geary ..... A41F 1/00 2/336
2012/0036615 A1 * 2/2012 Bradstreet ..... A41D 1/08 2/236
2012/0260401 A1 * 10/2012 Moskowitz ..... A44B 18/0003 2/231
2013/0007947 A1 * 1/2013 Moore ..... A41F 9/02 2/236
2013/0212767 A1 * 8/2013 Nordstom ..... A41D 31/185 2/69
2013/0239294 A1 * 9/2013 Clement ..... A41D 27/245 2/228
2014/0196194 A1 * 7/2014 Clarke ..... A41D 1/14 2/237
2014/0208484 A1 * 7/2014 Huff ..... A41F 9/025 2/243.1
2014/0259304 A1 * 9/2014 Mitchell ..... A41C 3/0057 2/400
2014/0331385 A1 * 11/2014 Okies ..... A41D 1/06 2/235
2015/0020286 A1 * 1/2015 Wilson, II ..... A41F 9/025 2/69
2015/0152578 A1 * 6/2015 Darby ..... D04B 1/104 66/171
2016/0135528 A1 * 5/2016 Baschak ..... A41F 9/00 2/244
2016/0262478 A1 * 9/2016 Moore ..... A41F 9/00
2016/0295927 A1 * 10/2016 Essery ..... A41B 9/001
2017/0258159 A1 * 9/2017 Moore ..... A41F 9/025
2017/0265531 A1 * 9/2017 Toussaint ..... A41D 7/005
2017/0295870 A1 * 10/2017 Harris ..... A41C 3/12
2017/0325512 A1 * 11/2017 Trebino ..... A41B 9/001
2018/0110275 A1 * 4/2018 Moffa ..... A41F 9/02
2018/0177253 A1 * 6/2018 Ritchie ..... A41F 9/025
2018/0228232 A1 8/2018 Fisher
2021/0076753 A1 * 3/2021 Johnson ..... A41B 9/14

FOREIGN PATENT DOCUMENTS

GB 707055 A 4/1954
GB 1404260 A 8/1975
GB 1463400 A 2/1977

OTHER PUBLICATIONS

Intention to Grant received for European Patent Application No. 17720349.4, dated Apr. 3, 2020, 6 pages.
Intention to Grant received for European Patent Application No. 17720349.4, dated Jan. 17, 2020, 6 pages.

* cited by examiner

TRIM PIECE FOR AN APPAREL ITEM

CROSS-REFERENCE TO RELATED APPLICATIONS

This application entitled, "Trim Piece for an Apparel Item," is a Divisional Application of U.S. application Ser. No. 15/486,800, filed Apr. 13, 2017, and entitled, "Trim Piece for an Apparel Item," which claims the benefit of priority of U.S. Prov. App. No. 62/323,855, entitled "Trim Piece for an Apparel Item," and filed Apr. 18, 2016. The entireties of the aforementioned applications are incorporated by reference herein.

TECHNICAL FIELD

The present disclosure relates to a trim piece, such as waistband, for an apparel item.

BACKGROUND

Various types of elastic trim pieces have been proposed for retaining pants, shorts, bras, and other apparel items on the torso of the wearer. Specifically, the trim piece can be an annular member that is attached to the apparel item and that is resiliently elastic. The trim piece can be slightly smaller in diameter than respective portions of the wearer's body such that, when the trim piece is applied to the apparel item, the wearer's body can resiliently expand the trim piece in a radially outward direction. As a result, the trim piece can bias radially inward to hold the apparel item to the wearer's body.

BRIEF DESCRIPTION OF THE DRAWINGS

The present invention is described in detail below with reference to the attached drawings figures, wherein.

DETAILED DESCRIPTION

Figure 1:
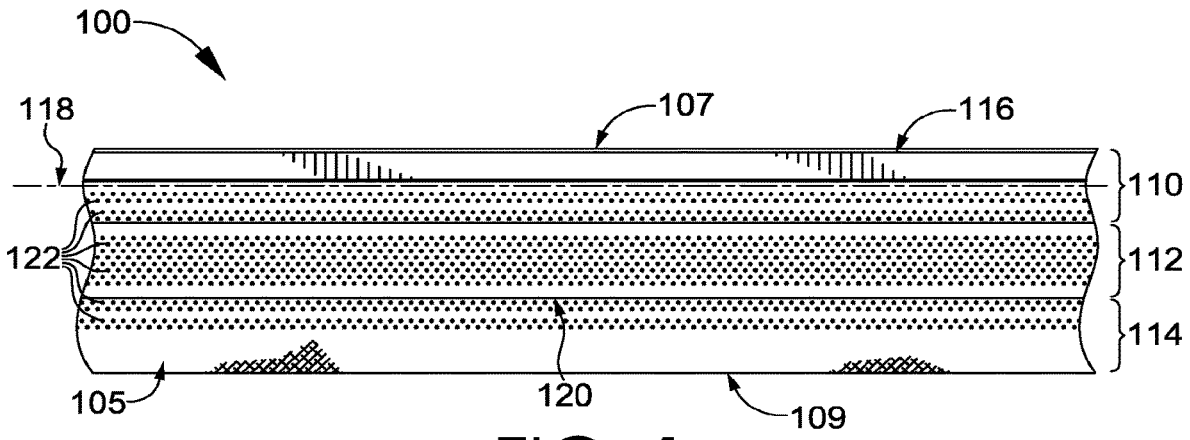
FIG. 1 depicts a plan view of a first surface of an exemplary trim piece in accordance with aspects herein.

The subject matter of the present invention is described with specificity herein to meet statutory requirements. However, the description itself is not intended to limit the scope of this disclosure. Rather, the inventors have contemplated that the disclosed or claimed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein are generally directed to an exemplary elastic trim piece, such as a waistband, an underband of a bra or other support garment, a sleeve cuff, a pant cuff, and the like, applied to an apparel item such that it is positioned primarily on an outer-facing surface of the apparel item. By positioning the trim piece so that it is primarily located on the outer-facing surface of the apparel item, often at areas of the apparel item having a high amount of skin contact, more of the fabric forming the apparel item can be maintained in contact with the wearer's body surface. This may be important in athletic apparel where the fabric forming the apparel item may exhibit performance characteristics such as, for example, faster drying times, moisture-management characteristics that help transport sweat or perspiration away from the body, breathability characteristics that facilitate the passage of moisture vapor through the fabric, permeability characteristics that facilitate the passage of air through the fabric, and the like.

The trim piece may comprise, in an exemplary aspect, an elasticized mesh material that may be divided into three longitudinally oriented zones, where each zone comprises a first surface and a second surface opposite the first surface. For instance, the trim piece may comprise a first zone, a second zone, and a third zone interposed between the first and second zones, where each zone comprises approximately one-third the width of the trim piece. In exemplary aspects, the first zone may comprise an optional silicone layer mounted on the first surface. And the third zone may comprise an optional tunnel structure that extends outwardly from the first surface where the tunnel structure is adapted to retain, for instance, a drawstring, an elasticized cord or band, and/or other cord-like structures. In exemplary aspects, the second surface of the trim piece opposite of the tunnel structure is "flat" or planar. One or more of the first, second, and third zones may have perforations extending therethrough.

In one exemplary aspect, when integrated into an apparel item having at least an outer-facing surface, a first edge, and an inner-facing surface, the second surface of the trim piece may be affixed to a portion of the outer-facing surface, the first edge, and a portion of the inner-facing surface, such that the first zone is folded over the first edge and is at least partially positioned on the inner-facing surface of the apparel item. Thus, when utilized, the silicone layer is positioned so that it is adjacent to a body surface of a wearer when the apparel item is worn. Continuing, the second zone and the third zone, with its optional tunnel structure, are positioned on the outer-facing surface of the apparel item. As such, approximately two-thirds or more of the trim piece is positioned on the outer-facing surface of the apparel item.

The configuration thus described may have a number of functional advantages. One advantage gained by forming the trim piece from an elastically resilient material is to enhance the ability of the trim piece to secure the apparel item to a wearer's body surface. Another advantage gained by positioning a majority of the trim piece on the outer-facing surface of the apparel item, is that a greater percentage of the fabric forming the inner-facing surface of the apparel item may be maintained in contact with the wearer's body surface in areas of high skin contact (e.g., waistband area, underband area, cuff area, and the like). Thus, performance characteristics of the fabric forming the apparel item (e.g., moisture management, dry times, breathability, permeability) are not inhibited or blocked by the trim piece. In another example, when the trim piece is incorporated as a waistband, the silicone layer positioned on the inner-facing surface of the apparel item may be used, for instance to help secure a jersey or shirt tucked into a pair of shorts or pants (i.e., help prevent the jersey from becoming untucked). In another example, when the trim piece is incorporated as an underband of a support garment such as a bra, the silicone layer may help maintain the position of the bra against the body of the wearer (i.e., help prevent the bra from shifting during movement).

Continuing, by positioning the tunnel structure on the trim piece such that it extends outwardly from the first surface of the trim piece, and by maintaining the second surface opposite the tunnel structure in a flat or planar configuration, the wearer's comfort may be improved as the tunnel structure and any cords it contains is positioned away from the wearer's body. By forming the trim piece to have perforations extending therethrough, the breathability and permeability characteristics of the trim piece are improved. Thus, the trim piece may work in concert with the fabric forming the apparel item to, for example, help air move through the trim piece to help cool the wearer, and/or to help moisture vapor generated by the wearer to escape the apparel item.

Accordingly, in a first aspect, a trim piece is provided comprising a first zone having a first surface and an opposite second surface, where the first zone has a longitudinal fold line. In an as-assembled configuration, the first zone is longitudinally folded along the fold line such that a first portion of the second surface is positioned adjacent to a second portion of the second surface. The trim piece further comprises a second zone, and a third zone interposed between the first zone and the second zone.

In another aspect, a trim piece incorporated into an apparel item is provided comprising a base layer comprising an inner-facing surface, an outer-facing surface, and a first edge. The trim pieces further comprises a mounting layer comprising a first surface and an opposite second surface, where the first surface is attached to the outer-facing surface, the first edge, and at least a portion of the inner-facing surface of the base layer.

In yet another aspect, a waistband for an article of apparel is provided comprising a base layer comprising an inner-facing surface, an outer-facing surface, and an upper edge. The waistband further comprises a mounting layer comprised of a first surface and an opposite second surface, the first surface being positioned adjacent to and attached to the outer-facing surface, the upper edge, and at least a portion of the inner-facing surface of the base layer. As well, the waistband comprises a silicone layer mounted on the second surface of the mounting layer, where the silicone layer is disposed on the waistband to face a wearer when the apparel item is in an as-worn configuration.

In another aspect, a trim piece incorporated into an article of apparel is provided a base layer comprising an inner-facing surface, an outer-facing surface, and a first edge. The trim piece further comprises an elastically resilient mounting layer comprised of a first surface, an opposite second surface, and at least a second edge, where the first surface is attached to the outer-facing surface of the base layer such that the second edge of the elastically resilient mounting layer is aligned with the first edge of the base layer.

Turning now to FIG. 1, a plan view of a first surface 105 of a portion of an exemplary trim piece 100 is provided in accordance with aspects herein. As used throughout this disclosure, the term "trim piece" may be used interchangeably with the term "mounting layer." In exemplary aspects, the first surface 105 may comprise an outer-facing surface of the trim piece 100 when the trim piece 100 is in an as-assembled or as-used configuration. The trim piece 100 may comprise a unitary piece (as opposed to two or more pieces affixed together) formed from an elastically resilient mesh material generated through a knitting or a weaving process. As used throughout this disclosure, the term elastically resilient may be defined as the ability of a material to stretch in response to a force and to return to a non-stretched state when the force is removed. In exemplary aspects, the trim piece 100 may be configured to be resiliently elastic in a circumferential direction. Thus, when incorporated into an apparel item at a specified location(s), a circumferential body surface of the wearer (e.g., waist, upper torso, ankle, wrist, neck) may push the annular trim piece 100 outward in a radial direction to resiliently stretch the trim piece 100 outwardly in a radial direction. The trim piece 100, in turn, can bias the apparel item radially inward against the wearer's body surface to help retain the apparel item against the body surface of the wearer. The elasticity of the trim piece 100 may be achieved through use of one or more synthetic or natural elastic yarns, fibers, or filaments such as Spandex, elastane, rubber, Lycra, and the like.

Figure 2:
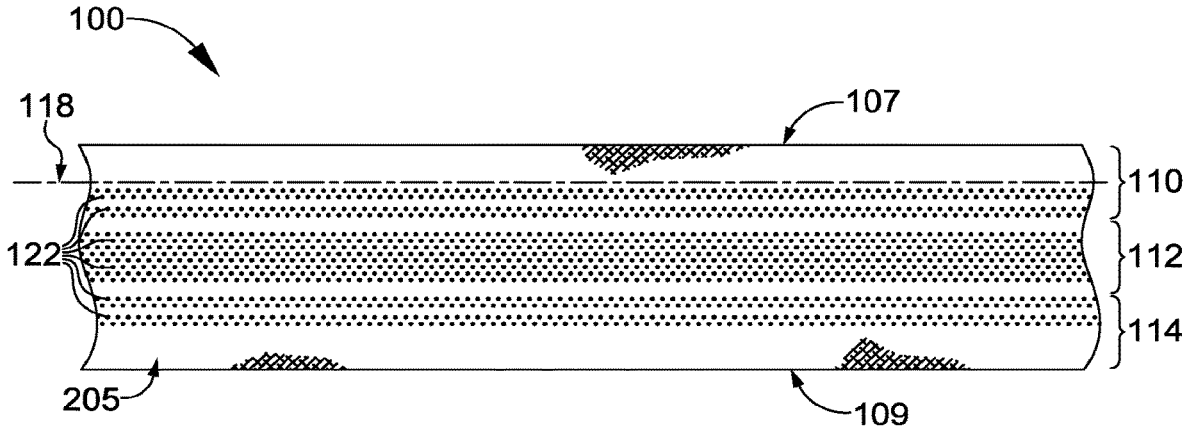
FIG. 2 depicts a plan view of a second opposite surface of the exemplary trim piece of FIG. 1 in accordance with aspects herein.

In exemplary aspects, the trim piece 100 may be divided into three hypothetical longitudinally oriented zones: a first zone 110, a second zone 114, and a third zone 112 interposed between the first zone 110 and the second zone 114. In exemplary aspects, each of the zones 110, 112, and 114 may comprise approximately one-third the width of the trim piece 100, although it is contemplated herein that a particular zone may comprise more than one-third or less than one-third the width of the trim piece 100. One or more of the first, second, and third zones 110, 114, and 112 may comprise perforations 122 extending through the thickness of the trim piece 100 to form a fluid communication path from the first surface 105 of the trim piece 100 to a second surface of the trim piece 100 (i.e., an inner-facing surface of the trim piece 100 as shown in FIG. 2). It is contemplated herein that the number, shape, size, and/or distribution pattern of the perforations 122 may be variable. Moreover, it is contemplated herein that the perforations 122 may be located on all three of the zones, two of the zones, or just one of the zones. Any and all aspects, and any variation thereof, are contemplated as being within aspects herein. The perforations 122 may be integrally formed through the knitting or weaving process used to form the trim piece 100, or the perforations 122 may be formed through, for instance, laser cutting, ultrasonic cutting, water-jet cutting, dissolving a reactive yarn, and the like.

With respect to the first zone 110, the first zone 110 may extend from a first edge 107 of the trim piece 100 to a location approximately one-fourth to one-third the width of the trim piece 100. In exemplary aspects, the first zone 110 may be longitudinally bisected by an optional fold line (indicated by reference numeral 118). In one exemplary aspect, the fold line 118 may comprise an area of the trim piece 100 having fewer stitches than other areas of the trim piece 100. This may be accomplished by dropping a made stitch at periodic intervals. The result is that there may be fewer yarns in this area as compared to other portions of the first zone 110 which may facilitate folding the first zone 110 along the fold line 118 as will be explained in greater detail below. However, it is contemplated herein that the fold line 118 may not have dropped stitches. Further, the first zone 110 may optionally comprise a silicone layer 116 mounted on the first surface 105 of the trim piece 100. As shown, the silicone layer 116 extends longitudinally along the length of the trim piece 100. In exemplary aspects, the silicone layer 116 may include flocking to or some other type of surface treatment to increase the softness or feel of the silicone layer 116. Other materials besides silicone are contemplated as being within the scope herein such as, for example, polyurethane, a releasable adhesive, thermoplastic polyurethane, rubber, and the like. In exemplary aspects, the width of the silicone layer 116 may comprise between 2.0 mm to 20 mm.

The second zone 114 may extend from a second edge 109 opposite the first edge 107 to a location approximately one-fourth to one-third the width of the trim piece 100. Continuing, the third zone 112 is interposed between the first and second zones 110 and 114 and may comprise approximately one-third the width of the trim piece 100. In exemplary aspects, the third zone 112 may comprise an optional tunnel structure 120 that extends longitudinally along the length of the trim piece 100 and extends outwardly from the first surface 105 of the trim piece 100. The tunnel structure 120 may be integrally formed by the knitting or weaving process used to form the trim piece 100. For example, the knitting or weaving process may be used to form two layers having a space or void between. When utilized, the tunnel structure 120 may contain a cord or band such as a drawstring, and elastic cord or band, and the like.

FIG. 2 depicts a plan view of a second surface 205 of the portion of the exemplary trim piece 100 of FIG. 1 in accordance with aspects herein. In exemplary aspects, the second surface 205 may comprise an inner-facing surface of the trim piece 100 when in an as-assembled and as-used configuration. As shown, the perforations 122 extend through the second surface 205 to form a fluid communication path through which, for instance, air and/or moisture vapor may travel. In exemplary aspects, the second surface 205 of the trim piece 100 is smooth, flat, or planar. For instance, although the tunnel structure 120 extends outwardly from the first surface 105, the second surface 205 opposite the tunnel structure 120 may be planar or flat. In exemplary aspects, the second surface 205 of the trim piece 100 may be the surface that is secured to an apparel item. Thus, by having the second surface 205 be flat or planar, a more secure attachment to the apparel item may be achieved.

Figure 3:
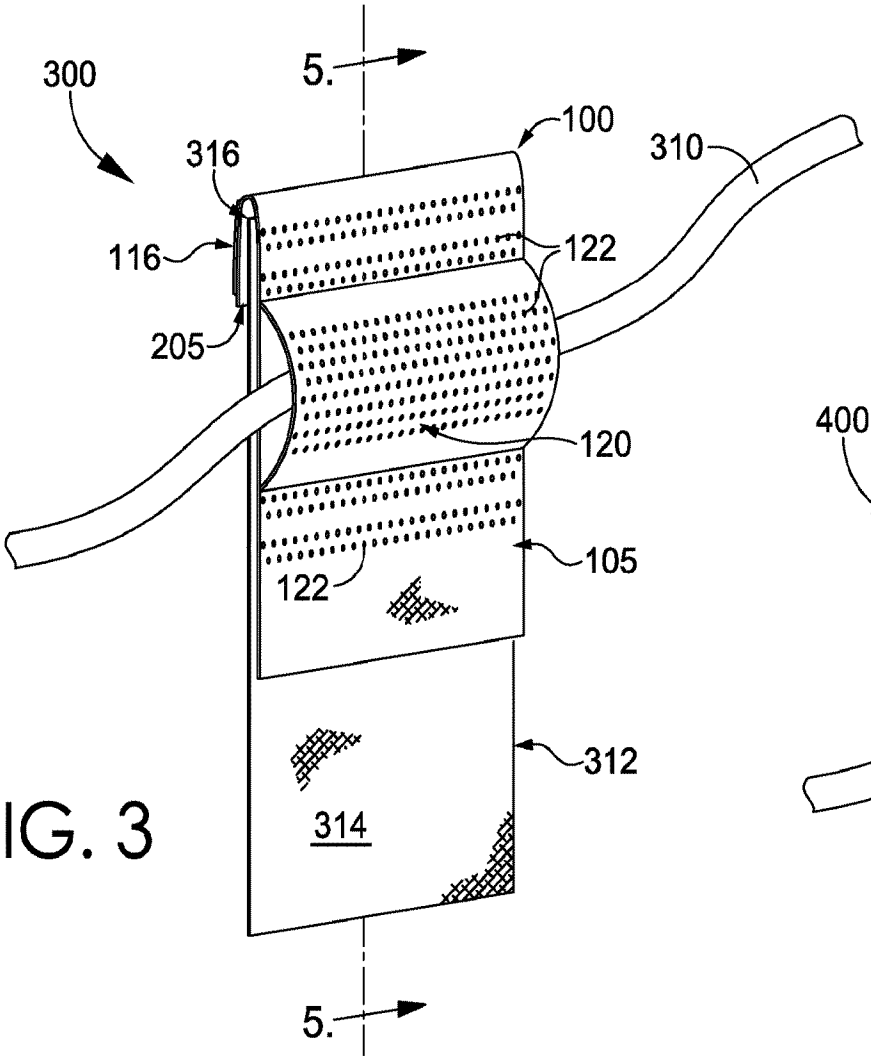
FIG. 3 depicts an exploded view of an exemplary trim piece being applied to an apparel item in accordance with aspects herein.

Turning now to FIG. 3, referenced generally by the numeral 300, an exploded view of the trim piece 100 being applied to an apparel item is illustrated in accordance with aspects herein. A portion of an apparel item 312 is depicted where the apparel item 312 has an outer-facing surface 314, a first edge 316, and an inner-facing surface (not shown in this view). As used throughout this disclosure, the portion of an apparel item to which a trim piece, such as the trim piece 100, may be applied may also be known as the base layer. The apparel item 312 may comprise a short, a pant, a sleeve, a pant leg, a bra or other type of support garment, a shirt, and the like. In exemplary aspects, the apparel item 312 may be formed from a material or fabric having performance characteristics such as faster drying times, moisture management capabilities, breathability characteristics, air permeability characteristics, and the like.

As depicted in FIG. 3, the second surface 205 of at least the second and third zones 114 and 112 of the trim piece 100 is positioned adjacent to the outer-facing surface 314 of the apparel item 312. The first zone 110 of the trim piece 100 is folded over the first edge 316 of the apparel item 312 at the fold line 118 (shown in FIG. 1). As such, a first portion of the second surface 205 of the first zone 110 is positioned adjacent to the outer-facing surface 314 of the apparel item 312 (where the first portion is the portion that is adjacent to the third zone 112 of the trim piece 100), and a second portion of the second surface 205 of the first zone 110 is positioned adjacent to the inner-facing surface of the apparel item 314 such that the first edge 107 of the trim piece 100 is positioned adjacent the inner-facing surface of the apparel item 312. As shown in FIG. 3, this positioning results in at least two-thirds to three-quarters of the trim piece 100 being positioned on the outer-facing surface 314 of the apparel item 312. Once positioned, the trim piece 100 may be secured to the apparel item 314 by using affixing technologies known in the art such as stitching, bonding, adhesives, welding, hook-and-loop fasteners, snaps, buttons, and the like.

Continuing with respect to FIG. 3, the tunnel structure 120 on the first surface 105 of the trim piece 100 is positioned adjacent the outer-facing surface 314 of the apparel item 312. A cord 310 is shown as being positioned within the tunnel structure 120. The cord 310 may comprise, for instance, a drawstring used to further secure the apparel item 312 to the wearer. The cord 310 may also comprise an elastic band to provide additional elasticity to the trim piece 100. Any and all aspects, and any variation thereof, are contemplated as being within the scope herein.

Because the first zone 110 of the trim piece 100 is at least partially folded over the first edge 316 of the apparel item 312, the silicone layer 116 is positioned adjacent to a body surface of a wearer when the apparel item 312 is worn. As described above, this arrangement may be useful for keeping jerseys or shirts tucked into pants or shorts, or helping keep a support garment such as a bra from "riding up" or shifting position during movement. The configuration shown in FIG. 3 further positions the perforations 122 extending through the trim piece 100 generally on the outer-facing surface 314 of the apparel item 312 where they can facilitate the passage of air into the apparel item 312, and/or facilitate the passage of moisture vapor out of the apparel item 312. However, it is contemplated herein that at least a portion of the perforations 122 may be positioned on the inner-facing surface of the apparel item 312. Any and all aspects, and any variation thereof, are contemplated as being within the scope herein.

Figure 4:
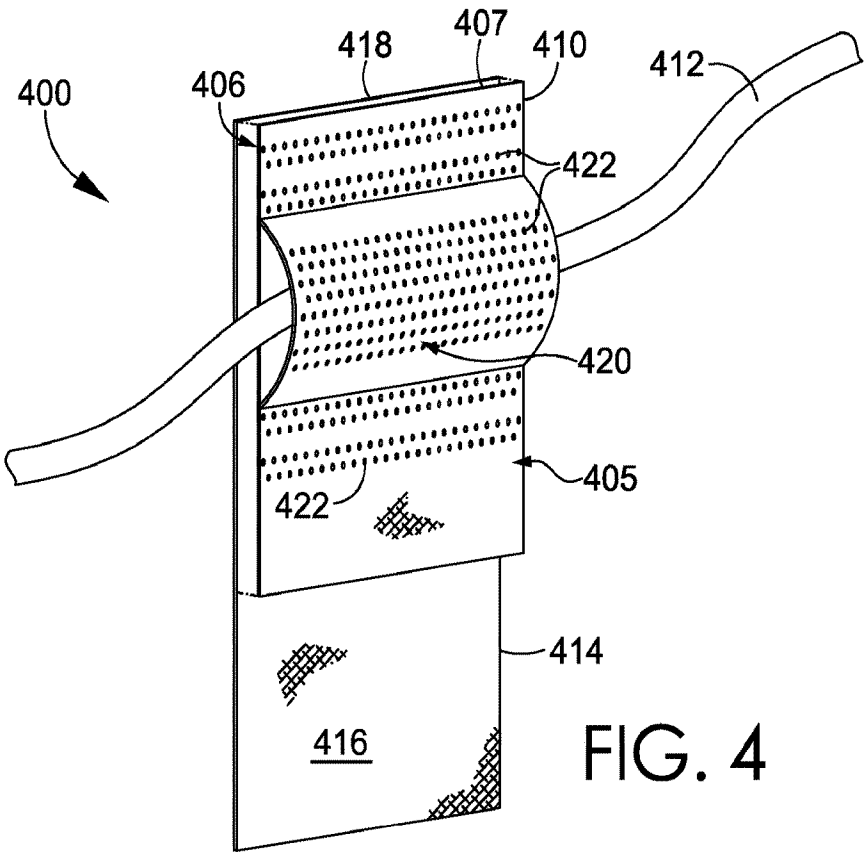
FIG. 4 depicts an exploded view of an alternative configuration for an exemplary trim piece being applied to an apparel item in accordance with aspects herein.

FIG. 4, referenced generally by the numeral 400, illustrates an exploded view of a trim piece 410 being applied to an apparel item in an alternative manner in accordance with aspects herein. Similar to FIG. 3, a portion of an apparel item 414 is depicted where the apparel item 414 has an outer-facing surface 416, a first edge 418, and an inner-facing surface (not shown in this view). The apparel item 414 may comprise a short, a pant, a sleeve, a pant leg, a bra or other type of support garment, a shirt, and the like. In exemplary aspects, the apparel item 414 may be formed from a material or fabric having performance characteristics such as faster drying times, moisture management capabilities, breathability characteristics, air permeability characteristics, and the like.

As discussed above, in exemplary aspects, the silicone layer 116 described with respect to the trim piece 100 may be optional. When not needed, and as shown in FIG. 4, an inner-facing surface 406 of the trim piece 410 may be affixed to the outer-facing surface 416 of the apparel item 414 such that the first, second, and third zones are positioned entirely on the outer-facing surface 416 of the apparel item 414. To put it another way, approximately 100% of the trim piece 410 is positioned on the outer-facing surface 416 of the apparel item 414. To put it yet another way, the trim piece 410 is positioned such that an edge 407 of the trim piece 410 is generally aligned with the first edge 418 of the apparel item 414. Once positioned, the trim piece 410 may be affixed or secured to the apparel item 414 using the affixing technologies described above. Although shown with a tunnel structure 420 and a cord 412, it is contemplated herein that the trim piece 410 may not comprise the tunnel structure 420. Moreover, it is contemplated herein, that a silicone layer may be mounted on one or more of the first, second and third zones of the trim piece 410 such that it is positioned adjacent to the outer-facing surface 416 of the apparel item 414. This may be useful, for instance, when the trim piece 410 is incorporated as an underband of a support garment such as a bra. By positioning the silicone layer adjacent an outer-facing surface of the support garment, the silicone layer may help to reduce the likelihood that an outer layer positioned over the support garment moves or shifts excessively during movement. It is contemplated that exemplary trim pieces may comprise just the silicone layer without the tunnel structure, with just the tunnel structure without the silicone layer, with both the silicone layer and the tunnel structure, or with neither the silicone layer nor the tunnel structure. Any and all aspects, and any variation thereof, are contemplated as being within the scope herein.

Figure 5:
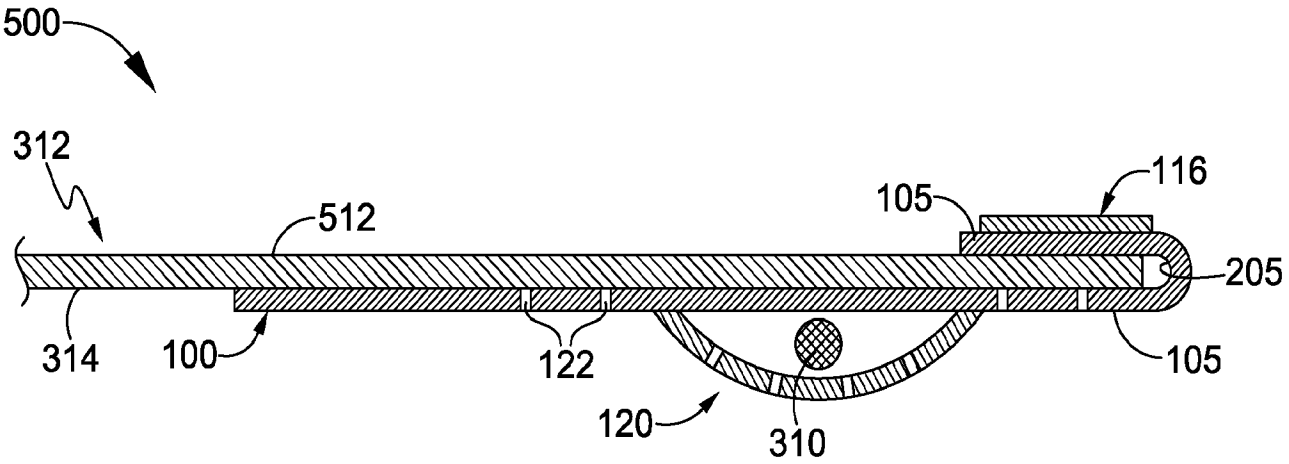
FIG. 5 depicts a cross-sectional view of the exemplary trim piece applied to the apparel item taken at cut line 5-5 of the FIG. 3 in accordance with aspects herein.

FIG. 5, referenced generally by the numeral 500, depicts a cross-sectional view taken along cut line 5-5 of FIG. 3 in accordance with aspects herein. As shown, the second surface 205 of the trim piece 100 is positioned adjacent to the apparel item 312. More specifically, at least two-thirds to three-quarters of the second surface 205 of the trim piece 100 is positioned adjacent to the outer-facing surface 314 of the apparel item 312, and less than one-third to one-quarter of the second surface 205 of the trim piece 100 is positioned adjacent to an inner-facing surface 512 of the trim piece 100. The perforations 122 are generally positioned adjacent the outer-facing surface 314 of the apparel item 312, and the silicone layer 116 is positioned adjacent the inner-facing surface 512 of the apparel item 312. FIG. 5 further depicts the tunnel structure 120 and the cord 310 contained within the tunnel structure 120. As shown, it is contemplated herein that the tunnel structure 120 may comprise the perforations 122.

Figure 6:
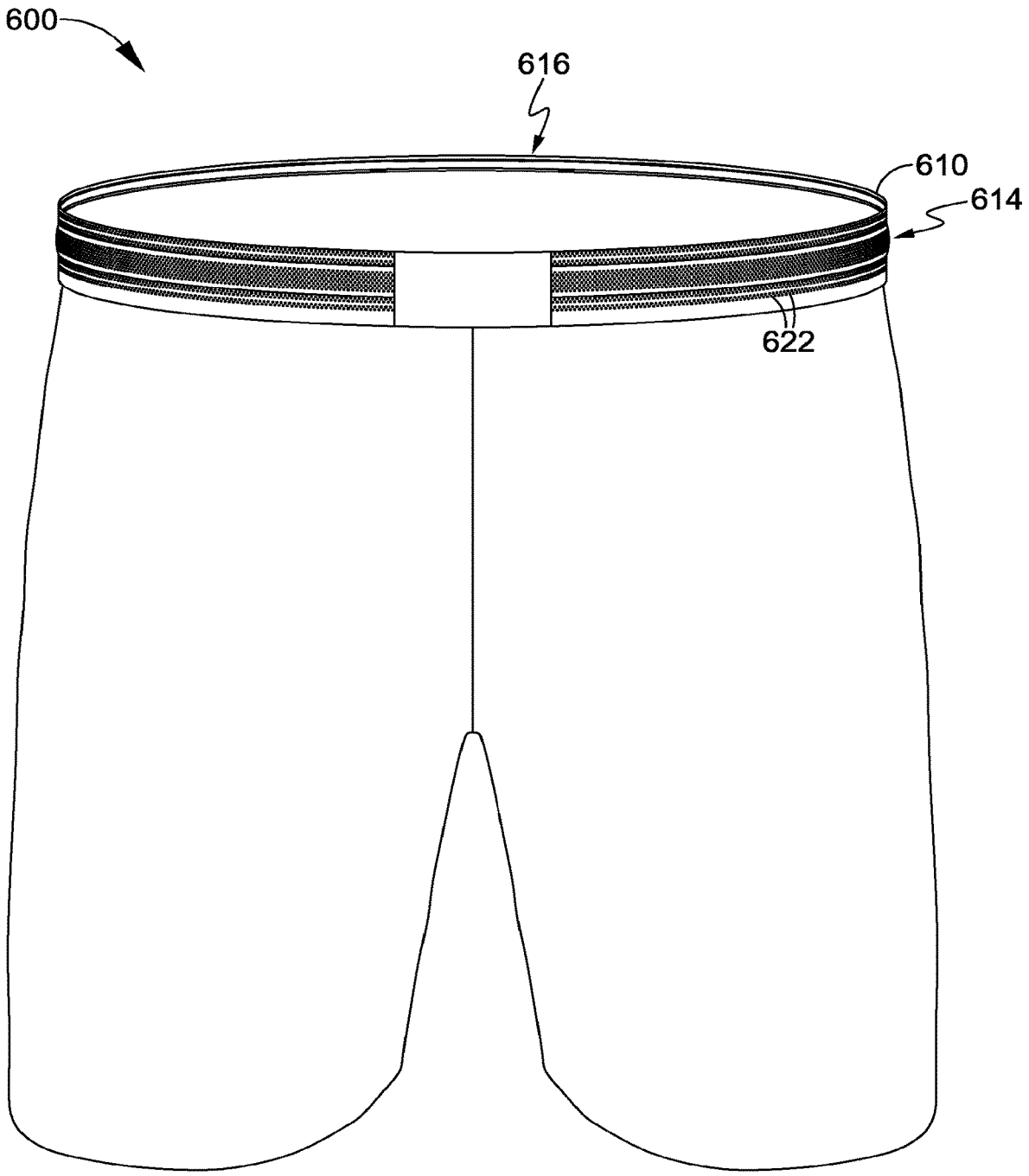
FIGS. 6 and 7 depict front and back views respectively of an exemplary trim piece applied to a pair of shorts in accordance with aspects herein.
Figure 7:
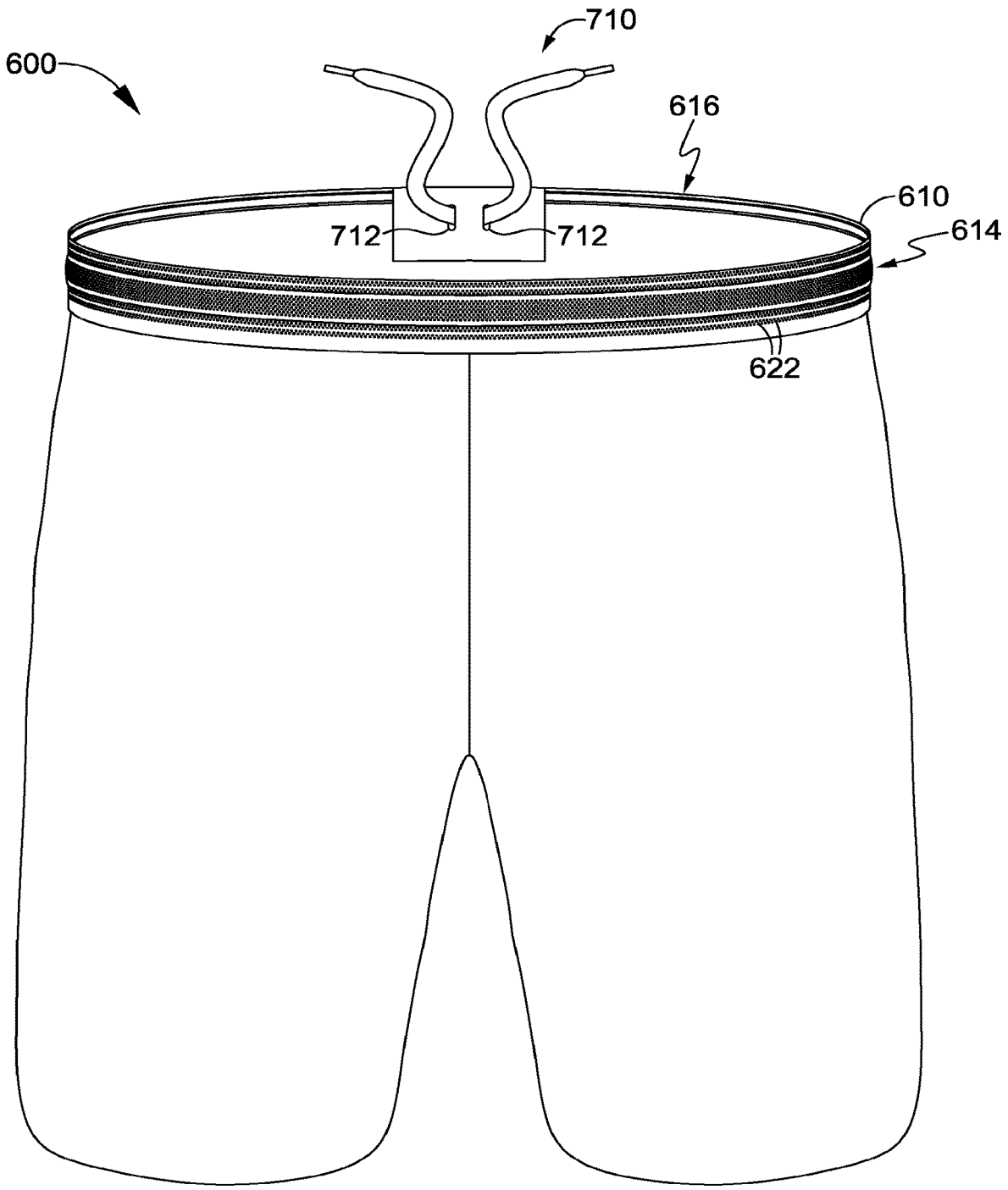
Figure 8:
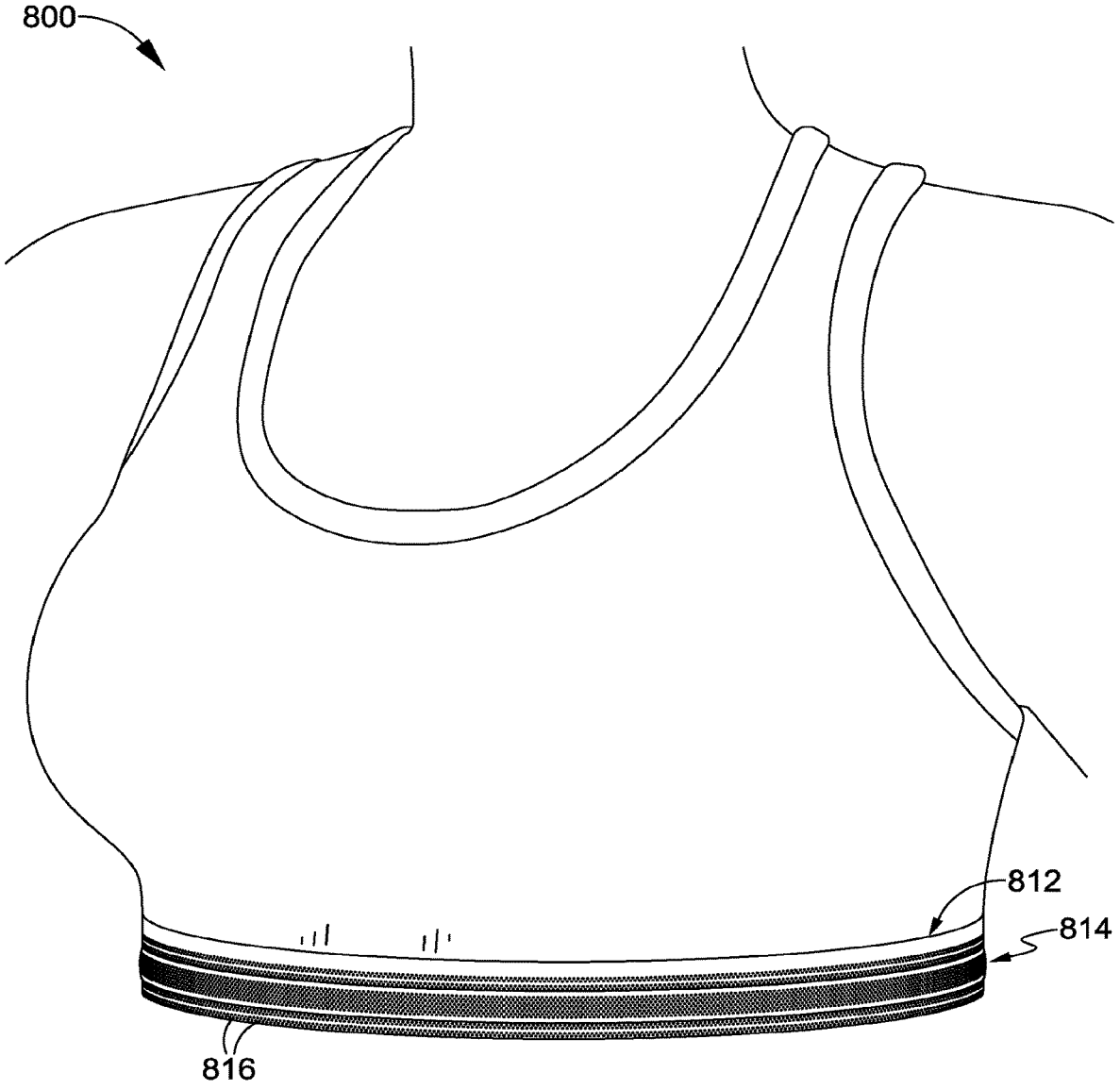
FIG. 8 depicts a front view of an exemplary trim piece applied to a support garment in accordance with aspects herein.

Exemplary trim pieces described herein may be incorporated into a number of different apparel items such as those shown in FIGS. 6-8. For example, FIG. 6 depicts a front view of an exemplary pair of shorts 600 having an annular waistband formed from a trim piece 610 having attributes described herein, and FIG. 7 depicts a back view of the short 600 in accordance with aspects herein. The elasticity of the trim piece 610 allows the trim piece 610 to stretch or elongate in a circumferential direction around the waist of a wearer and to recover such that the trim piece 610 biases toward the wearer in a radial direction. In general, when biased inward, the trim piece 610 is configured to lie substantially flat against the wearer (without bunching or pleating). The area of the shorts 600 in which the trim piece 610 is incorporated may comprise an area of high contact with the body surface of the wearer (due to, for instance, the elastic characteristics of the trim piece 610) as opposed to other areas of the shorts 600 such as the leg portions which may naturally drape away from the wearer. As such, configuring the trim piece 610 such that it is positioned primarily on the outer-facing surface of the shorts 600 enables more of the short fabric to remain in contact with the wearer's body surface in areas of high skin contact where the fabric may be used, for example, to transport moisture and/or sweat away from the wearer.

As shown in FIG. 6, perforations 622 extending through the trim piece 610 are positioned generally adjacent the outer-facing surface of the shorts 600, although it is contemplated herein that some of the perforations 622 may be positioned adjacent the inner-facing surface of the shorts 600. A silicone layer 616 is positioned adjacent an inner-facing surface of the shorts 600 next to to an upper edge or margin of the shorts 600. The silicone layer 616 may be used to help prevent the waistband from shifting during movement and/or to help prevent a shirt tucked into the shorts 600 from becoming untucked. Further, the trim piece 610 comprises a tunnel structure 614 positioned adjacent the outer-facing surface of the shorts 600.

FIG. 7 depicts a rear view of the shorts 600 and is provided to illustrate how a drawstring 710 positioned within the tunnel structure 614 may exit the tunnel structure 614. More specifically, ends of the drawstring 710 may exit apertures 712 that communicate with or extend into the tunnel structure 614. The ends of the drawstring 710 may exit on the inner-facing surface of the shorts 600 though it is contemplated that they may also exit on the outer-facing surface of the shorts 600. The drawstring 710 may be used to further circumferentially tension the trim piece 610 around the waist of the wearer. In exemplary aspect, the shorts 600 may not comprise a drawstring 710 (or its corresponding tunnel structure 614) or may contain an elasticized cord in place of the drawstring 710. Any and all aspects, and any variation thereof, are contemplated as being within the scope herein.

FIG. 8 depicts a front view of a support garment 800 having an underband formed from a trim piece 812 having attributes as described herein. The underband is generally positioned at a lower margin of the support garment 800. Although the support garment 800 is shown as a bra, it is contemplated herein that the support garment 800 may comprise, for instance, a shirt base layer, a camisole, a swim top, and the like. The elasticity of the trim piece 812 may help to secure this portion of the support garment 800 against the torso of the wearer. In exemplary aspects, the trim piece 812 is located on the support garment 800 such that at least two-thirds and up to 100% of the trim piece 812 is positioned on an outer-facing surface of the support garment 800 thus enabling more of the fabric forming the support garment 800 to remain in contact with the wearer's skin surface.

Although not shown, it is contemplated herein that the trim piece 812 may comprise a silicone layer, such as the silicone layer 116, positioned adjacent to an inner-facing surface of the support garment 800 (i.e., next to a wearer's skin surface when the support garment 800 is worn). Use of the silicone layer may help to prevent the support garment 800 from shifting during movements. However, it is contemplated herein that the silicone layer may not be used or may be placed on an outer-facing surface of the trim piece 812. Further, as shown, the trim piece 812 comprises perforations 816 that extend through the thickness of the trim piece 812 to help promote breathability and air permeability of the trim piece 812. The trim piece 812 may further optionally comprise a tunnel structure 814. In exemplary aspects, the tunnel structure 814 may contain a drawstring or an elasticized cord or band to impart additional elastic characteristics to the trim piece 810.

Although shown as being incorporated into a short, such as the shorts 600, or a support garment, such as the support garment 800, it is contemplated that the exemplary trim piece described herein may be incorporated into portions of other apparel items configured to circumferentially or annularly surround a body surface of a wearer. Examples include socks, wrist cuffs, jacket or shirt waistbands, hats, and the like. Any and all aspects, and any variation thereof, are contemplated as being within the scope herein.

The present invention has been described in relation to particular examples, which are intended in all respects to be illustrative rather than restrictive. Alternative embodiments will become apparent to those of ordinary skill in the art to which the present invention pertains without departing from its scope. Certain features and subcombinations are of utility and may be employed without reference to other features and subcombinations and are contemplated within the scope of the disclosure and the claims.

What is claimed is:

1. A combination of a lower-body apparel item and a waistband, wherein:

the lower-body apparel item is formed from a first panel of material comprising an innermost surface and an outermost surface of the lower-body apparel item, wherein the first panel of material extends continuously and terminates at a first terminal end that forms an uppermost edge of a waist opening of the lower-body apparel item; and the waistband includes a first surface and an opposite second surface, the first surface and the second surface extending from a first longitudinal terminal end to a second longitudinal terminal end opposite the first longitudinal terminal end, wherein an entirety of the second surface of the waistband directly abuts the outermost surface of the lower-body apparel item such that the first longitudinal terminal end of the waistband is aligned with the first terminal end of the first panel of material forming the uppermost edge of the waist opening of the lower-body apparel item.

2. The combination of the lower-body apparel item and the waistband of claim 1, wherein the lower-body apparel item is one of a pant or a short.

3. The combination of the lower-body apparel item and the waistband of claim 1, wherein the waistband is elastically resilient.

4. The combination of the lower-body apparel item and the waistband of claim 1, wherein the waistband includes a plurality of perforations.

5. The combination of the lower-body apparel item and the waistband of claim 1, further comprising:

a longitudinally oriented tunnel structure that extends outward from the first surface of the waistband; and a cord structure, the tunnel structure adapted to retain the cord structure, wherein the second surface of the waistband opposite the tunnel structure is planar.

6. The combination of the lower-body apparel item and the waistband of claim 5, wherein the cord structure includes one of an elastic cord or a drawstring.

7. The combination of the lower-body apparel item and the waistband of claim 1, wherein the waistband is a unitary construction.

8. The combination of the lower-body apparel item and the waistband of claim 1, further comprising a silicone layer positioned on the innermost-surface of the lower-body apparel item.

9. The combination of the lower-body apparel item and the waistband of claim 8, wherein the silicone layer includes flocking.

10. The combination of the lower-body apparel item and the waistband of claim 1, wherein the first longitudinal terminal end and the second longitudinal terminal end are located above one or more lower openings of the lower-body apparel item.

11. A lower-body apparel item comprising:

a torso portion formed from a first panel of material, the first panel of material comprising an innermost surface and an outermost surface of the torso portion, wherein the first panel of material extends continuously and terminates at a first terminal end that forms an uppermost edge of a waist opening in the lower-body apparel item; and a waistband including a first surface and an opposite second surface, the first surface and the second surface extending from a first longitudinal terminal end to a second longitudinal terminal end opposite the first longitudinal terminal end, wherein an entirety of the second surface of the waistband directly abuts the outermost surface of the torso portion of the lower-body apparel item such that the first longitudinal terminal end of the waistband is aligned with the first terminal end of the first panel of material forming the uppermost edge of the waist opening of the lower-body apparel item and the second longitudinal terminal end of the waistband is positioned below the first longitudinal terminal end.

12. The lower-body apparel item of claim 11, wherein the lower-body apparel item is one of a pant or a short.

13. The lower-body apparel item of claim 11, wherein the waistband is elastically resilient.

14. The lower-body apparel item of claim 11, wherein the waistband includes a plurality of perforations.

15. The lower-body apparel item of claim 11, further comprising:

a longitudinally oriented tunnel structure that extends outward from the first surface of the waistband; and a cord structure, the tunnel structure adapted to retain the cord structure, wherein the second surface of the waistband opposite the tunnel structure is planar.

16. The lower-body apparel item of claim 15, wherein the cord structure includes one of an elastic cord or a drawstring.

17. The lower-body apparel item of claim 11, wherein the waistband is a unitary construction.

18. The combination of the lower-body apparel item and the waistband of claim 11, further comprising a silicone layer positioned on the innermost-surface of the lower-body apparel item.

19. The lower-body apparel item of claim 18, wherein the silicone layer includes flocking.

20. The lower-body apparel item of claim 11, wherein the first longitudinal terminal end and the second longitudinal terminal end are located above one or more lower openings of the lower-body apparel item.

* * * * *